United States Patent [19]

Stuecker

[11] Patent Number: 4,963,854

[45] Date of Patent: Oct. 16, 1990

[54] LIGHT BULB SHAPED AUDIO SIGNAL EMITTER

[76] Inventor: Barry M. Stuecker, 5225 E. Taylor, Phoenix, Ariz. 85008

[21] Appl. No.: 390,824

[22] Filed: Aug. 8, 1989

[51] Int. Cl.[5] ..... G10K 9/00

[52] U.S. Cl. ..... 340/384 E; 340/656; 340/693; 181/141; 362/253; 381/205; 381/188; 324/508

[58] Field of Search ..... 340/384 E, 656, 693, 340/474; 381/88, 90, 205, 188; 181/141; 455/351, 346; 362/253; 324/506, 510, 511, 538, 508

[56] References Cited

U.S. PATENT DOCUMENTS

| | | | |
|---|---|---|---|
| 1,134,360 | 4/1915 | Walker | 340/474 |
| 2,924,661 | 2/1960 | Messeas, Jr. | 381/188 |
| 4,630,248 | 12/1986 | Scott | 340/566 |
| 4,730,184 | 3/1988 | Bach | 340/539 |
| 4,776,018 | 10/1988 | Cordier | 381/205 |
| 4,851,813 | 7/1989 | Gottlieb | 340/384 E |

OTHER PUBLICATIONS

"Sonalert Electronic Audible Signal"; Mallory Distributor Products for 9-398 B, 10/66.

*Primary Examiner*—Joseph A. Orsino
*Assistant Examiner*—Jill Jackson

[57] ABSTRACT

This light bulb shaped device is comprised of a one hundred and ten volt buzzer wired to a threaded light bulb type metal base. The sound from this buzzer is amplified by an unbreakable plastic megaphone. The interior works of this device is protected from tampering by affixing a protective unbreakable plastic grill at the large end of the megaphone. This entire device is intended to be screwed into a typical light bulb socket in order to emit an audio alarm signal. This occurs when the light bulb socket is energized by a surge of one hundred and ten volt current.

6 Claims, 1 Drawing Sheet

LIGHT BULB SHAPED AUDIO SIGNAL EMITTER

REFERENCE

This light bulb shaped audio signal emitter can be constructed by utilizing piezo transducers or electromechanical buzzers similar to ones that are available and described in the Nineteen Eighty Nine Radio Shack Catalog on page one hundred thirty one.

BRIEF SUMMARY OF INVENTION

The object of this invention is to provide a familiar light bulb shaped audio signal emitting device that can be used in lieu of a light bulb in any light bulb type socket. This invention is so designed to facilitate an audio alarm signal when an energized one hundred and ten volt electrical circuit would normally activate a light bulb or floodlight secured into a typical light socket. This invention has its most useful application when used in a light bulb socket that is part of a known interior or exterior motion detector device.

DESCRIPTION OF THE PREFERRED EMBODIMENTS

Figure 1:
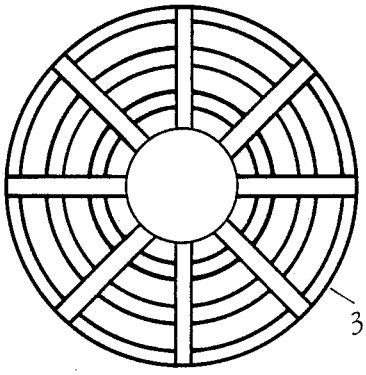
FIG. 1. Is the front view of the unbreakable plastic snap on protective grill.
Figure 2:
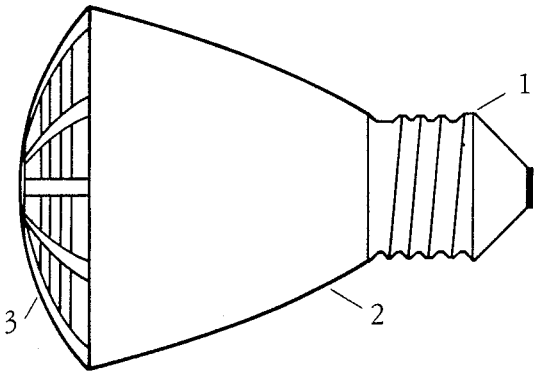
FIG. 2. Is the side view of the light bulb shaped unbreakable plastic megaphone including the grill and metal screw base.
Figure 3:
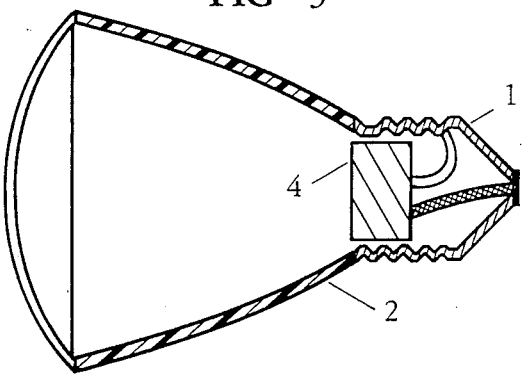
FIG. 3. Is the section view through the device showing the placement and wire diagram of the piezo transducer.

This invention relates to a light bulb shaped audio signal emitter using either a piezo transducer or an electromechanical buzzer as the sound source. The metal screw type light bulb base #1 is of the size and shape consistent with a light bulb utilizing a one hundred and ten volt light bulb socket. The metal screw base #1 is to be secured in a permanent manner to the extruded unbreakable plastic megaphone #2. The manner of the attachment of #1 to #2 is also to be of a weatherproof type to allow the use of this invention at both exterior or interior light sockets. The extruded unbreakable plastic grill #3 is to be fashioned with prongs so as to snap onto the large end of the megaphone #2. This connection with #3 to #2 should be in a manner so that they can no longer be separated in order to allow access into the insides of the megagphone #2. The piezo transducers or also the electromechanical buzzers #4 used as the sound source should be capable of producing a sound range between eighty to a hundred and five decibels. These buzzers should use one hundred and ten volt power at approximately one hundred and twenty milli amperage. These buzzers will use fewer than fifteen watts and be wired to the screw type light bulb base #1 in a manner consistent to allow proper contact when this invention is screwed into any light bulb type socket. The proposed shape of this invention and also the familiar light bulb type base #1 should facilitate easy understanding and manner of installation of this invention, by the consumer, into any common light bulb socket.

What is claimed:

1. An audible alarm device comprising:

a housing having a central axis about which a threaded exterior end portion of electrically conductive material extends, the threads being sized to fit in a threaded electrical socket normally used for electrical lamps and there being a central terminal element that is insulated from said threaded exterior;

said housing having an interior throat section of reduced size which extends forwardly of the threaded exterior end and a forward portion, which radially expands along the central axis to provide acoustical frequency amplification and which terminates in an open forward end; and an audible frequency generator positioned in said reduced size throat and electrically connected directly to the threaded exterior and to the central terminal whereby the presence merely of an operating voltage in said electrical socket will cause generator produced audio frequency energy that is transmitted by the interior throat section of the forward portion of the housing.

2. A device as defined in claim 1 wherein the audio frequency generator is an electro-mechanical buzzer device operating at household power frequency.

3. A device as defined in claim 1 wherein the audio frequency generator is a piezo transducer device.

4. A device as defined in claim 1 further having an open grid member attached to the forward end of the housing to protect said audible frequency generator.

5. A device as defined in claim 4 wherein the housing has a generally conical shape which serves as a megaphone and is made of a synthetic resin.

6. An audible alarm device comprising:

a housing having a central axis about which a threaded exterior end portion of electrically conductive material extends, the threads being sized to fit in a threaded electrical socket normally used for electrical lamps powered by a voltage of 120 volts at 60 Hz. and there being a central terminal element that is insulated from said threaded exterior;

said housing having an interior throat section of reduced size which extends forwardly of the threaded exterior end and a forward portion, which radially expands along the central axis to provide acoustical frequency amplification and which terminates in an open forward end; and an audio frequency generator positioned in said reduced size throat and electrically connected directly to the threaded exterior and to the central terminal whereby the sole presence of said voltage in said electrical socket will cause generator produced audio frequency energy that is amplified by the interior throat section of the forward portion of the housing.

* * * * *